United States Patent [19]

Sano

[11] Patent Number: 4,559,887

[45] Date of Patent: Dec. 24, 1985

[54] SWITCHING MECHANISM OF CONTROL AMOUNT IN ELECTRONIC CONTROL SEWING MACHINE

[75] Inventor: Yasuro Sano, Tokyo, Japan

[73] Assignee: Janome Sewing Machine Co., Ltd., Tokyo, Japan

[21] Appl. No.: 571,513

[22] Filed: Jan. 16, 1984

[30] Foreign Application Priority Data

Jan. 20, 1983 [JP] Japan ..... 58-5487

[51] Int. Cl.[4] ..... D05B 3/02

[52] U.S. Cl. ..... 112/455; 112/459

[58] Field of Search ..... 112/158 E, 158 B, 158 R, 112/158 A, 158 D

[56] References Cited

U.S. PATENT DOCUMENTS 4,196,683 4/1980 Eguchi ..... 112/158 E 4,299,180 11/1981 Kume et al. ..... 112/158 E

*Primary Examiner*—Peter Nerbun

*Attorney, Agent, or Firm*—Michael J. Striker

[57] ABSTRACT

An electronic control sewing machine for producing stitching patterns by storing as programs in a memory the pattern signals for the amount of needle bar amplitude and the amount of fabric feed, includes control motors having output shafts which have rotational outputs and are driven in response to the pattern signals per rotation of the sewing machine. The machine further includes pawl members having pawls, and cam bodies positioned on the output shafts of the control motors and each including a plurality of cam faces. The pawl members and the pawls are switched to different ones of the plurality of cam faces by the control motors in accordance with the programs stored in the memory of the sewing machine.

4 Claims, 12 Drawing Figures

SWITCHING MECHANISM OF CONTROL AMOUNT IN ELECTRONIC CONTROL SEWING MACHINE

BACKGROUND OF THE INVENTION

The present invention relates to an electronic control sewing machine which stores, as pattern signals, the amounts of needle bar amplitude and fabric feed, drives control motors per rotation of the sewing machine in response to the pattern signals, outputs rotations of the control motors via cam mechanisms, and produces stitching patterns, and more particularly relates to switching mechanisms of the control amounts of the electronic sewing machine.

For the control motor of the electronic sewing machine, a pulse motor of hybrid type is structurally suitable to control, since small stepping angles may be obtained thereby. However, machining process of high precision is required for obtaining the small stepping angle, for which high expense is a problem. On the other hand, a pulse motor of inductor type belonging to PM (permanent magnet) is produced at cheaper cost, but since the small stepping angles could not be obtained thereby due to its structure, it is not suitable for the control motor of the electronic control sewing machine.

With respect to the fabric feed amount in the control amounts in formation of stitching patterns by the electronic control sewing machine, such a fine feeding amount of about 0.25 mm is required for buttonhole stitching. For this object, it is practiced to divide 8 mm of the feed control range between a forward side 5 mm and backward side 3 mm into 38 steps.

In the amount of a needle bar amplitude, if the amplitude control range is divided into 24 steps for all of the patterns, such a division is sufficient.

In the electronic control sewing machine which outputs rotation of the control amount via the cam mechanisms, if the feed control range is divided into 32 steps and the amplitude control range is divided into 24 steps, and if the pulse motor of the inductor type of the stepping angle 7.5° is used, the control ranges will be $32\times7.5°=240°$ concerning the feed and will be $24\times7.5°=180°$ concerning the amplitude.

Ordinary stitching patterns have moderate changings of the fabric feed amount and the needle bar amplitude amount. In an example, for instance, shown in FIG. 1, the maximum change of the fabric feed amount is from needle droppings (3)–(4) to needle droppings (4)–(5). Assuming that the needle droppings (3)–(4) are forward 5 steps and the needle droppings (4)–(5) are forward 12 steps, the changing amount is 7 steps (52.5°). The maximum change of the amplitude amount is 8 steps between the needle droppings (7) and (8). There is no problem about positioning time of the control motor.

However, concerning the fabric feed amount, its changing amount is often large in special stitching patterns. For instance, in an example of feather stitchings shown in FIG. 2, the maximum change of the fabric feed amount is from the needle dropping (3)–(4) to the needle droppings (4)–(5). Assuming that the needle droppings (3)–(4) are the forward 12 steps and the needle droppings (4)–(5) are the backward 12 steps, the changing amount is 24 steps and 180° in calculation. Therefore, such a special stitching pattern (called "large feed stitching pattern" hereinafter) takes a large time for the positioning of the control motor, and it is necessary to reduce the rotation speed of the main shaft of the sewing machine.

There is a special stitching pattern, the changing amount of which is large with regards to the needle amplitude amount. In zigzag stitching, for instance, shown in FIG. 3 where the needle drops at a left basic line L and a right basic line R, changings are made by 24 steps per each stitch (180° in calculation). Therefore such stitchings (called "large amplitude stitching pattern" hereinafter) take to a large time for the positioning of the control motor, as seen in the feed, and it is necessary to reduce the rotation speed of the main shaft.

As having mentioned, the pulse motor of the inductor type is unsuitable for producing the large feed stitching pattern and the large amplitude stitching pattern, since the small stepping angles are not obtained.

SUMMARY OF THE INVENTION

The present invention is to provide the switching mechanisms of the control amounts, using the control motors of comparatively large stepping angles to be incorporated into the electronic sewing machine which produces stitching patterns by outputting rotations of the control motors as the control amounts via the cam mechanisms.

BRIEF DESCRIPTION OF THE DRAWINGS

FIG. 1 is "normal stitching pattern", FIG. 2 is "large feed stitching pattern" and FIG. 3 is "large amplitude stitching pattern", FIG. 4 is a disassembled perspective view of the main part of the sewing machine, FIG. 5 is a disassembled perspective view of main part of a switching mechanism of the fabric feed amount, FIG. 6 is a plan view of the main part shown in FIG. 5, FIG. 7 is a graphic representation of the control amount of the switching mechanism of the fabric feed amount, FIG. 8 is a plan view showing a cam body composed of laminated cams, FIG. 9 is a view seen from an arrow C in FIG. 8, FIG. 10 is a plan view of the main part of the switching mechanism of the needle amplitude amount, FIG. 11 is a plan view of a switching mechanism of the fabric feed amount other than those shown in FIGS. 4 to 6, and FIG. 12 is a graphic representation of the control amount of the switching mechanism shown in FIG. 11.

DETAILED DESCRIPTION OF THE PREFERRED EMBODIMENTS

Figure 4:
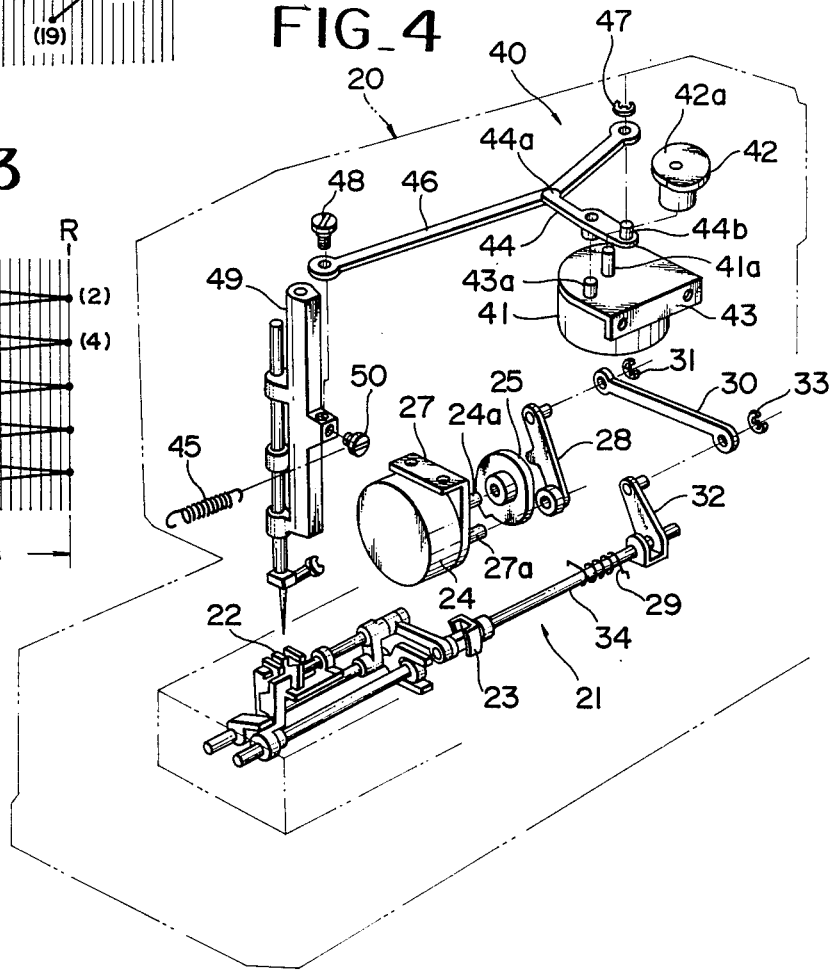
FIGS. 4 to 12 are embodiments according to the present invention, where

The invention will be explained with embodiments shown in the attached drawings. In FIG. 4, the numeral 20 is a machine body, and 21 is a fabric feed controller. The fabric feed amount mode by a feed dog 22, is controlled by the obliquity of a fabric feed adjuster 23. Explanation will be made referring to FIG. 5, too. A feed control motor 24 has secured to its output shaft **24*a*, by screws 26 a feeding cam body 25. A feeding pawl member 28 is mounted with its one end on a shaft 27*a* which extends from an attaching plate 27 fixed to the housing of the control motor 24**.

The pawl member 28 is turnable around the shaft **27*a* of the attaching plate 27, and a pawl 28*a* is pressed to a cam face 25*a* of the cam body 25 by action of a spring 29** via a later mentioned mechanism.

A feed rod 30 is mounted with its one end on a shaft 28b of the pawl member 28, and is thrust-stopped by an E-ring 31, while the rod 30 is mounted with its other end on a shaft 32a of a feed control arm 32, and is thrust-stopped by E-ring 33.

The feed control arm 32 is mounted on a shaft 34 that secures the feed adjuster 23, and is fixed by a screw 35. The spring 29 biases the shaft 34 to rotate in the clockwise direction in FIG. 5. By this biasing force, the pawl member 28 is biased in the clockwise direction around the shaft 27a of the feed control motor 24 via the feed control arm 32 and the feed rod 30, and the pawl 28a is pressed to the cam face 25a as mentioned above.

An explanation will be made in detail to a switching mechanism of the fabric feed amount of the control amounts in reference to FIG. 6. The present embodiment uses a pulse motor of an inductor type for a control motor, and its stepping angle is 7.5°.

Figure 1:
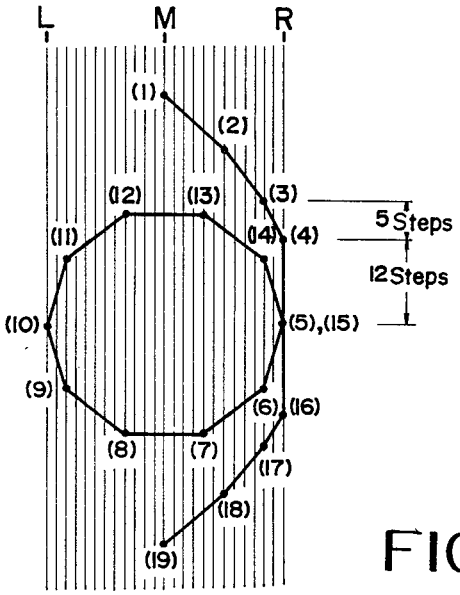
FIGS. 1 to 3 are linear stitching patterns, where
Figure 6:
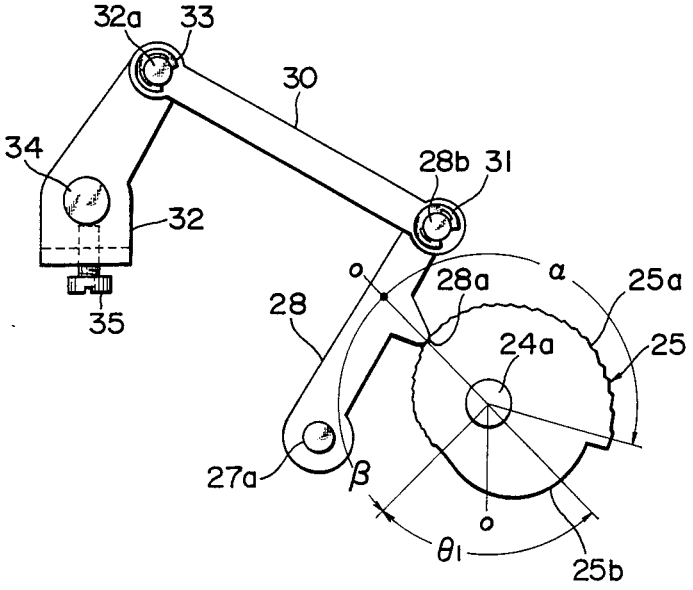

The feeding amount of the normal feed is 0 when the cam face 25a of the cam body 25 contacts the pawl 28a of the pawl member 28 as shown in FIG. 6. The cam face 25a has 0.25 mm pitches, and a forward side has 20 steps (angle $\alpha$) and a backward side has 12 steps (angle $\beta$) in order to obtain control ranges in the forward side of 5 mm and in the backward side of −3 mm. Since the stepping angle of the control motor 24 is 7.5°, $\alpha=150°$ is obtained and $\beta=90°$ is obtained, and this range of 240° is the feed control range of the normal stitching patterns as shown in FIG. 1.

Figure 2:
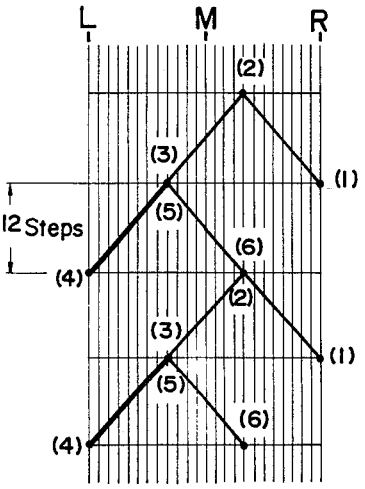

A cam face 25b is defined in contiguity of the cam face 25a. The cam face 25b is for controlling the forward 3 mm and the backward −3 mm by half stepping number of the cam face 25a. The condition that the cam body 25 rotates by 18 steps in the clockwise direction from a state shown in FIG. 6, corresponds to a condition of the feed amount 0, and the forward side and the backward side are each 6 steps, yielding a total of 12 steps (angle $\theta 1$). Since the stepping angle of the control motor 24 is 7.5°, $\theta=90°$ is obtained and this range of 90° is a feed control range of large feed stitching patterns as shown in FIG. 2.

Figure 7:
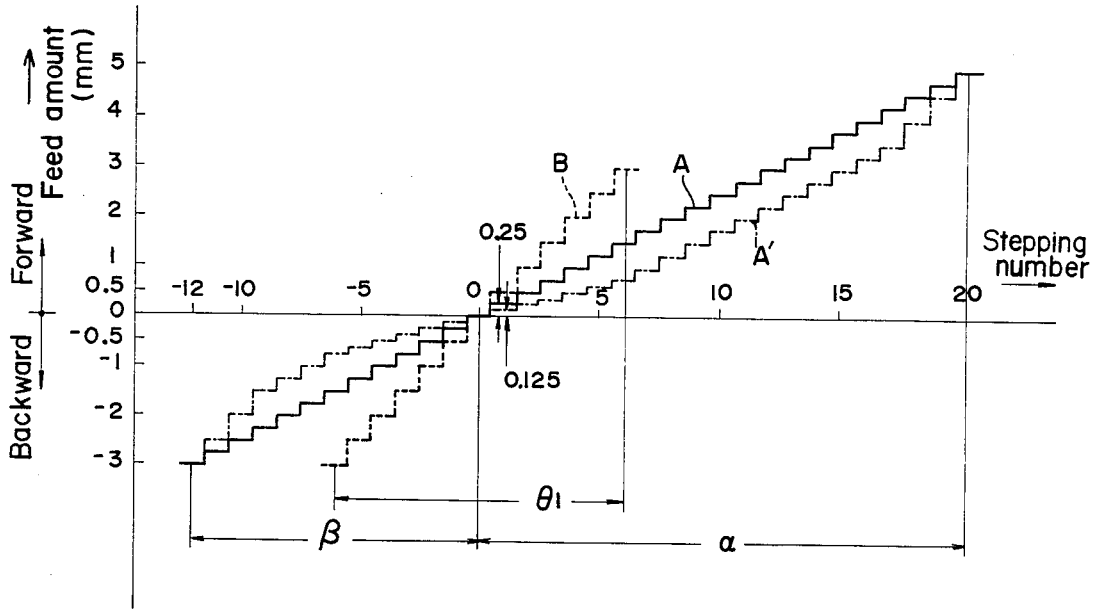

The control amounts by the cam faces 25a and 25b are expressed as shown in FIG. 7. In FIG. 7, the stepping numbers are from the feed 0 of the cam faces 25a and 25b. In the forward side and the backward side, the countings of the stepping numbers are reversed to each other. A is the control amount of the cam face 25a for controlling the normal stitching pattern. B is the control amount by the cam face 25b for controlling the large stitching pattern. A′ is the control amount by a cam face (not shown) of another embodiment. The cam face 25a is determined by changing shapes of the cams so that 0–6 steps of the forward side are 0.125 mm pitches, 7–17 steps are 0.25 mm pitches and 18–20 steps are 0.5 mm pitches, while 0–6 steps of the backward side are 0.125 mm pitches, 7–9 steps are 0.25 mm pitches, and 10–12 steps are 0.5 mm pitches.

If the control parts of the forward side 0.125 mm and the backward side −0.125 mm of said cam face are used, buttonhole stitching or the like of fine feed amount may be achieved.

Figure 8:
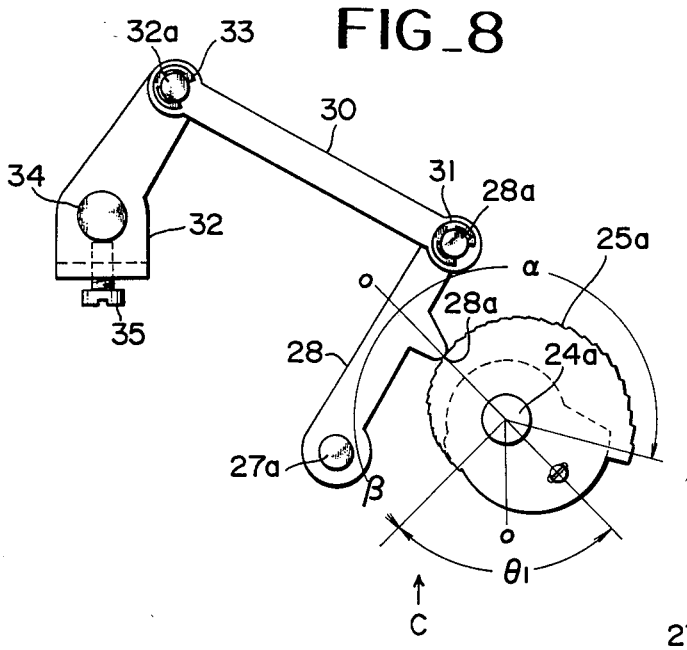
Figure 9:
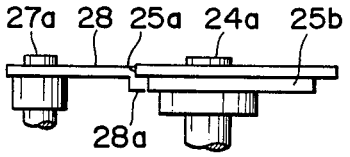

The cam face 25a and the cam face 25b are produced in one body as shown in FIG. 6, otherwise the cam face 25a and the cam face 25b are produced independently as shown in FIG. 8 and both are laminated into one body. In the latter, fine adjustments may be made on positioning relation between the feed 0 of the cam face 25a and the feed 0 of the cam face 25b. In this case, the thickness side of the pawl 28a of the pawl member 28 covers over both of the cam faces 25a and 25b as shown in FIG. 9.

In FIG. 4, the numeral 40 is a needle amplitude controller, and a cam body 42 is secured on an output shaft 41a of an amplitude control motor 41.

A pawl member 44 for amplitude is mounted on a shaft 43a extending from an attaching plate 43 fixed to the housing of the control motor 41. The pawl member 44 is turnable around the shaft 43a, and a pawl 44a is pressed to a cam face 42a of the cam body 42 by action of a spring 45 via a later mentioned mechanism. A shaft 44b of the pawl member 44 is mounted with an amplitude rod 46 at its one end, and is thrust-stopped by E-ring 47, and the amplitude rod 46 is connected at its other end to a needle bar supporter 49 via a stepped screw 48.

The spring 45 biases the needle bar supporter 49 in the clockwise direction via a screw 50 with respect to the center of its movement, and also biases the pawl member 44 around the shaft 43a by the biasing force via the amplitude rod 46 with respect to the center of its movement, and presses the pawl 44a to the cam face 42a.

A switching mechanism of a needle amplitude amount will be explained with reference to FIG. 10. In the present embodiment, the stepping angle of the control motor 41 is 7.5°.

Figure 10:
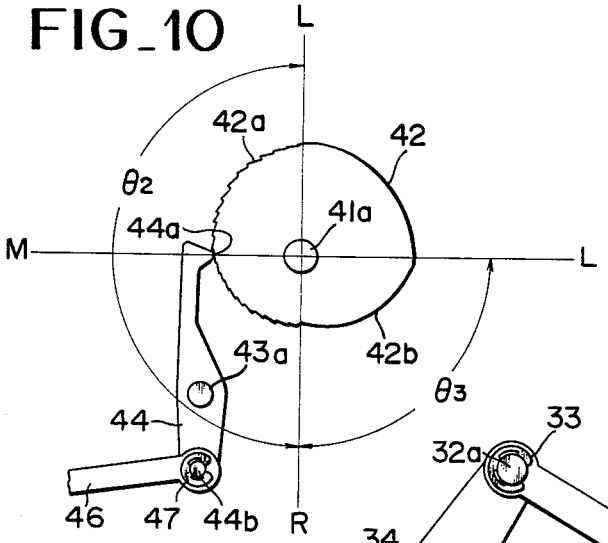

A condition that the cam face 42a of the cam body 42 contacts the pawl 44a of the pawl member 44 at the position shown in FIG. 10, has a middle basic line (M) of the normal amplitude. The cam face 42a is $\frac{1}{3}$ mm pitches, and in order to obtain the control ranges of respective 4 mm in the sides from the middle basic line (M) to the left basic line (L) and to the right basic line (R), the total 24 steps (angle $\theta 2$) of respective 12 steps are used. Since the stepping angle of the control motor 41 is 7.5°, $\theta 2=180°$ is obtained, and this range of 180° is an amplitude control range of the normal stitching pattern.

Figure 3:
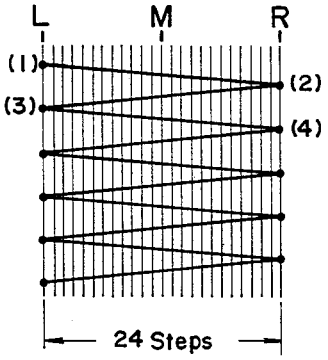

A cam face 41b is defined in contiguity of the cam face 41a. The cam face 41b is for controlling 8 mm between the left basic line (L) and the right basic line (R) by half stepping number of the cam face 42a, and 12 steps (angle $\theta 3$) are used for controlling from the right basic line (R) to the left basic line (L). Since the stepping angle of the control motor 41 is 7.5°, $\theta 3=90°$ is obtained, and this range of 90° is an amplitude control range of the large amplitude stitching pattern as shown in FIG. 3.

The cam face 42a and the cam face 42b are produced in one body as shown in FIG. 10. Besides, the cam face 42a and the cam face 42b are produced independently and the both are laminated into one body. In this case, the thickness side of the pawl 44a of the pawl member 44 covers over both of the cam faces 42a and 42b.

With respect to a switching mechanism of the fabric feed amount in dependence upon the other embodiment than that shown in FIG. 6, an explanation will be made with reference to FIG. 11. In this embodiment, added are a cam face 51a corresponding to the cam face 25a shown in FIG. 6, a cam face 51b corresponding to the cam face 25b, and further a cam face 51c for small pitch feed. In this embodiment, the stepping angle of the control motor is 7.5°.

Figure 11:
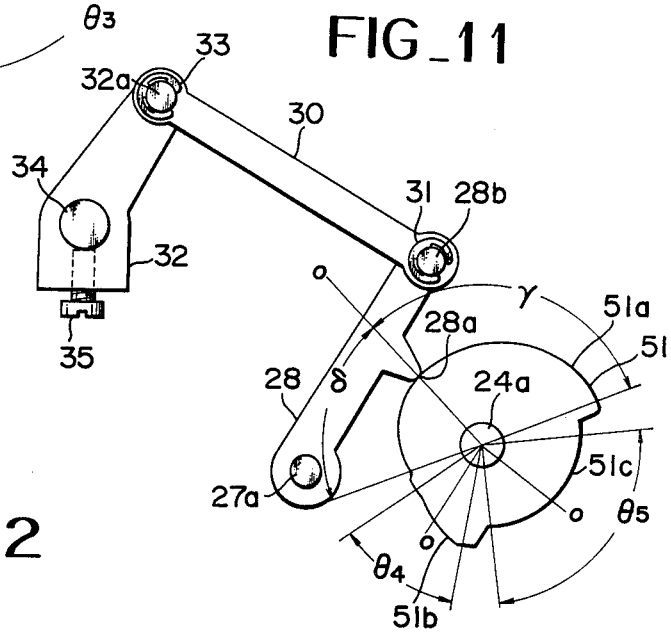

The condition that the cam face 51a of the cam body 51 contacts the pawl 28a of the pawl member 28 at the position shown in FIG. 11, is the feed amount 0 of the normal feed. The cam face 51a has $\frac{1}{3}$ mm pitches, and in order to obtain the control ranges of the forward side 5 mm and the backward side −3 mm, the forward side of 15 steps (angle $\gamma$) and the backward side of 9 steps (angle $\delta$) are used. Since the stepping angle of the control motor 24 is 7.5°, $\gamma=112.5°$ and $\delta=67.5°$ are obtained, and this range of 180° is a feed control range of the normal stitching pattern.

The cam face 51*b* is for controlling the forward side 2.5 mm and the backward side −2.5 mm by the stepping number less than the cam face 51*a*. The condition that the cam body 51 rotates by 14 steps in the clockwise direction from the state shown in FIG. 11, corresponds to the feed amount 0, and the total of 6 steps (angle $\theta 4$) of the forward side of 3 steps and the backward side of 3 steps are used. Since the stepping angle of the control motor 24 is 7.5°, $\theta=45°$ is obtained, and this range of 45° is a feed control range of the large feed stitching pattern.

The cam face 51*c* is defined in contiguity of the cam face 51*b*. A condition that the cam body 51 further rotates by 11 steps in the clockwise direction from a state of the feed amount 0 of the cam face 51*b*, is the feed amount 0 and 0.125 mm pitches, and the total of 12 steps (angle $\theta 5$) 6 steps in the forward side and 6 steps in the backward side are used. Since the stepping angle of the control motor 24 is 7.5°, $\theta=90°$ is obtained, and this range of 90° is a feed control range of the buttonhole stitching.

Figure 12:
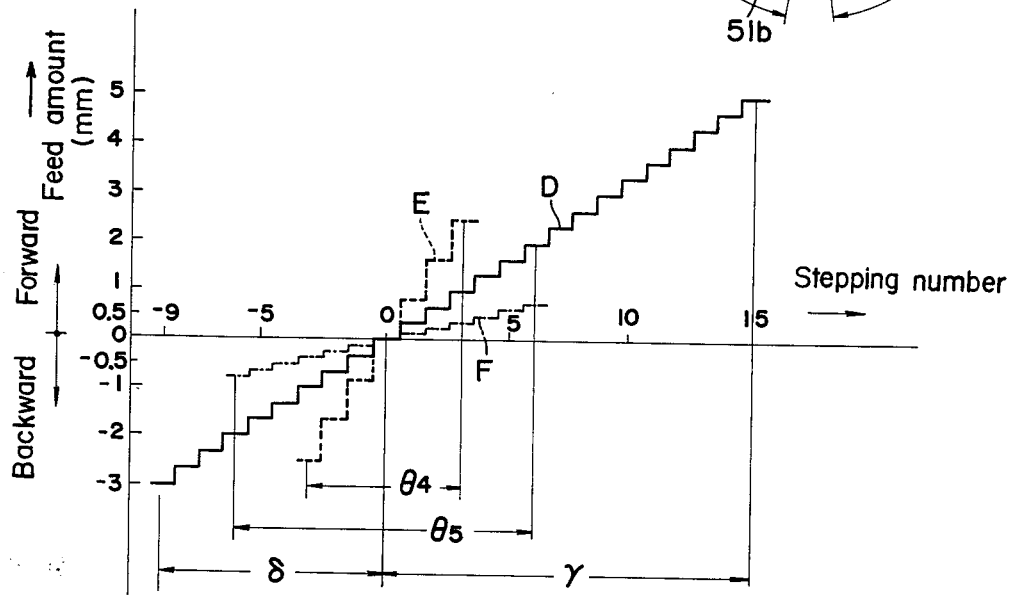

The control amounts of the cam face 51*a*, the cam face 51*b* and the cam face 51*c* are expressed as shown in FIG. 12. In FIG. 12, the stepping numbers are from the feeds 0 of these respective cam faces. In the forward side and the backward side, the countings of the stepping numbers are reverse from one another. D is the control amount of the cam face 51*a* for controlling the normal stitching pattern. E is the control amount of the cam face 51*b* for controlling the large feed stitching pattern. F is the control amount of the cam face 51*c* for controlling the small pitch.

A further explanation will be made to actuations of the invention, at first, the switching mechanism of the fabric feed amount shown in FIGS. 4 to 6 and the switching mechanism of the needle bar amplitude amount.

The cam body 25 is rotated by means of the control motor 24 in accordance with programs stored in a memory means of the sewing machine, and the cam body 25 is switched to the control by the cam face 25*a* and the control by the cam face 25*b*. This switching is carried out in association with operation of the pattern selection. The same is also true with respect to the switching between the cam faces 42*a* and 42*b* of the cam body of the needle amplitude.

That is, if the normal stitching pattern as shown in FIG. 1 is selected, the cam face 25*a* is selected with regard to the feed, and the cam face 42*a* is selected with regard to the amplitude, and the stitching pattern shown in FIG. 1 is produced.

If the large feed stitching pattern is selected from the above condition, the switching is effected from the cam face 25*a* to the cam face 25*b* with regard to the feed, but regarding the amplitude the cam face 42*a* remains, and the large feed stitching pattern shown in the same is produced. In this case, the needle droppings (3)–(4) are performed by the forward 6 steps, and the needle droppings (4)–(5) is performed by the backward 6 steps. The changing amount is 12 steps (90°) and the problem about the time of positioning control is solved.

If the large amplitude stitching pattern as shown in FIG. 3 is selected from the above condition, the switching is effected from the cam face 25*b* to the cam face 25*a* with regard to the feed, and the switching is effected from the cam face 42*a* to the cam face 42*b* with regard to the amplitude, and the large amplitude stitching pattern shown in the same is produced. In this case, the needle droppings (1)–(2), (2)–(3) . . . are performed by the 12 steps (90°), respectively and the problem about the time of positioning control is solved.

Figure 5:
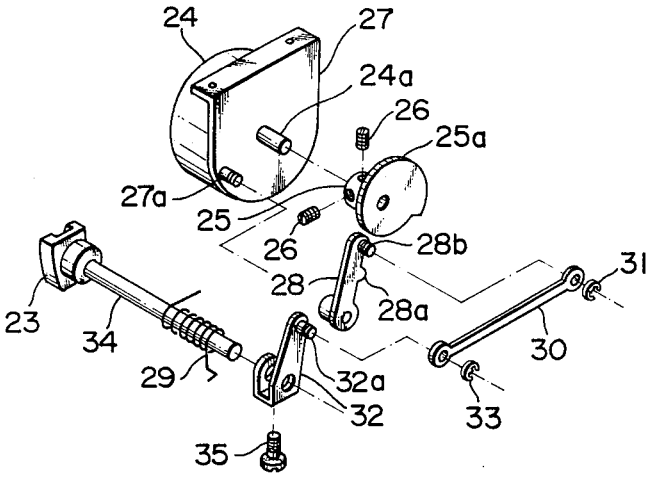

Also with respect to the switching mechanism of the fabric feed amount shown in FIG. 11 of the other embodiment than the switching mechanism of the fabric feed amount shown in FIGS. 4 to 6, the feeding cam body 51 is rotated by means of the control motor 24 in accordance with the programs stored in the memory means of the sewing machine, and the switching is effected to the controls by the cam face 51*a*, the cam face 51*b* and the cam face 51*c* in association with the operation of the pattern selection.

In accordance with the present invention, the electronic control sewing machine produces the stitching patterns by issuing output of the rotation of the control motors as the control amounts via the cam mechanism, in which the switching mechanisms of the control amounts by the comparatively large control motors may be used.

What is claimed is:

1. An electronic control sewing machine having a fabric feeding mechanism for feeding a fabric in forward and rearward directions and a needle bar with a needle reciprocated vertically and being swingable laterally of the fabric feeding directions to produce stitching patterns in accordance with pattern signals stored in a memory as the programs for controlling the amount of a needle bar amplitude and the fabric feeding amount of the feeding mechanism, the sewing machine comprising;

(a) a control motor having an output shaft driven in response to the pattern signals per rotation of the sewing machine to produce rotational outputs for controlling at least one of said amount of said needle bar amplitude and said fabric feeding amount of said feeding mechanism;

(b) a cam body positioned on said output shaft of said control motor and secured to said shaft and including a plurality of cam faces of different contours shaped so as to modify said rotational outputs of said control motor;

(c) a cam follower engaging said cam faces of said cam body; and (d) transmission means having one end connected to said cam follower and the other end connected to one of said needle bar and said fabric feeding mechanism, whereby modified rotational outputs of said control motor are transmitted to one of said needle bar and said fabric feeding mechanism.

2. An electronic control sewing machine having a fabric feeding mechanism for feeding a fabric in forward and rearward directions and a needle bar with a needle reciprocated vertically and being swingable laterally of the fabric feeding directions to produce stitching patterns in accordance with pattern signals stored in a memory as programs for controlling the amount of a needle bar amplitude and the fabric feeding amount of the feeding mechanism, the sewing machine comprising;

(a) a plurality of control motors each having an output shaft driven in response to the pattern signals per rotation of the sewing machine to produce rotational outputs for controlling the amount of the needle bar amplitude and the fabric feeding amount of the feeding mechanism;

(b) a plurality of cam bodies each positioned on a respective output shaft of a respective control motor and secured to said shaft and including a plurality of cam faces of different contours shaped so as to modify said rotational outputs of said control motors;

(c) a plurality of cam followers each engaging the cam faces of a respective cam body, and (d) a plurality of transmission means each having one end connected to a respective cam follower and the other end connected to one of said needle bar and said fabric feeding mechanism, whereby modified rotational outputs of said control motors are transmitted to one of said needle bar and said fabric feeding mechanism.

3. The machine as defined in claim 1, wherein said cam follower is a pawl member including a pawl pressed against said cam faces, said transmission means including a feed rod interconnected between said pawl member and one of said needle bar and said fabric feeding mechanism.

4. The machine as defined in claim 1, wherein said cam body is made of laminating material.

* * * * *